US005245840A

United States Patent [19]

Van Steenburgh, Jr.

[11] Patent Number: 5,245,840

[45] Date of Patent: * Sep. 21, 1993

[54] REFRIGERANT RECLAIM METHOD AND APPARATUS

[76] Inventor: Leon R. Van Steenburgh, Jr., 850 E. Lane Devils Gulch Rte., Estes Park, Colo. 80517

[ * ] Notice: The portion of the term of this patent subsequent to Sep. 24, 2008 has been disclaimed.

[21] Appl. No.: 928,931

[22] Filed: Aug. 12, 1992

Related U.S. Application Data

[62] Division of Ser. No. 727,612, Jul. 10, 1991, Pat. No. 5,176,008.

[51] Int. Cl.[5] ..... F25B 45/00

[52] U.S. Cl. ..... 62/292; 62/77

[58] Field of Search ..... 62/292, 77, 149, 84

[56] References Cited

U.S. PATENT DOCUMENTS 2,972,235 2/1961 Smith ..... 62/84

4,646,527 3/1987 Taylor ..... 62/85

4,903,499 2/1990 Merritt ..... 62/149

5,050,401 9/1991 Van Steenburgh ..... 62/292

*Primary Examiner*—Albert J. Makay

*Assistant Examiner*—William C. Doerrler

*Attorney, Agent, or Firm*—Beaton & Swanson

[57] ABSTRACT

A refrigerant reclaim method and apparatus is described wherein a separate primary refrigeration pathway is utilized to drive refrigerant to be reclaimed through a secondary refrigeration pathway. The primary refrigeration pathway is comprised of a compressor, the hot side of a first heat exchange element, a condenser, a receiver and an evaporator, which is in part comprised of the cold side of a second heat exchange element. The secondary refrigeration pathway is comprised of the cold side of the first heat exchange element, a oil separation chamber, the hot side of the second heat exchange element, and a refrigerant storage cylinder.

6 Claims, 3 Drawing Sheets

REFRIGERANT RECLAIM METHOD AND APPARATUS

This is a divisional of copending application Ser. No. 07/727,612 filed on Jul. 10, 1991 now U.S. Pat. No. 5,176,008 issued Jan. 5, 1993.

FIELD OF THE INVENTION

This application describes a method and apparatus for the reclamation of refrigerant. More particularly, the present invention is directed to a device that is capable of drawing refrigerant from a refrigerant-containing system, cleaning and drying such refrigerant, storing the refrigerant until it is needed, and charging the same or a different refrigerant-containing system with the clean and dried refrigerant. The refrigerant reclaim of the present invention is capable of reclaiming any and all currently used refrigerants and any new refrigerants that will be developed in the future.

BACKGROUND OF THE INVENTION

In the not-to-distant past, there was little or no consideration given to the reclamation of refrigerant. Because of environmental ignorance and low costs, when a refrigeration system (e.g., refrigeration or freezer units, air conditioning units, etc.) would break down or when the refrigerant in such system would become contaminated to the point that the effectiveness of the refrigeration system was compromised, the refrigerant would simply be vented into the atmosphere.

Recent developments based on environmental concerns have greatly effected how refrigerant must be handled. In many areas throughout the world it is now illegal to vent refrigerants to the atmosphere--in almost any quantity. In addition, and not coincidentally, the price of refrigerants has also risen dramatically. There is now a significant demand for refrigerant reclaim systems capable of drawing refrigerant from a refrigeration system, cleaning and storing said refrigerant for reuse. Systems that can perform this function 1) efficiently, 2) with little or no mechanical failures, and 3) on all commercially utilized refrigerants (and those new refrigerants that are being and will be developed in the future) will find an enormous market.

One of the major obstacles in this field, is that there are already a variety of refrigerants commonly in use. The type of refrigerant utilized for a particular application is based generally on the load requirements and temperature ranges required. Each of the refrigerants utilized (e.g., those commonly referred to as R-12, R-500, R-11, R-22, R-502) have different boiling points and heats of vaporization, and the design of a single reclaim that will accommodate all of these refrigerants has been elusive. In particular, new cost-effective reclaim systems capable of working with R-11—a refrigerant used in many large commercial air conditioning and refrigeration systems—are highly desirable.

Although a wide variety of reclaim designs exist, most refrigerant reclaims fit within one of two general types of systems. In the first type of reclaim, the driving force for drawing the refrigerant from the refrigeration system is a refrigerant compressor. Because effective refrigerant reclaims must be capable of evacuating both liquid and gaseous refrigerant, these reclaims must first assure that the refrigerant is completely vaporized before it enters the compressor. The refrigerant then needs to be condensed for storage. At some point, the refrigerant is passed through some purification element.

U.S. Pat. No. 4,967,570 of Van Steenburgh, Jr. (the inventor of the present application) is illustrative of this type of reclaim. A heat exchange element is used to make the vaporization and condensation steps of the process more efficient. After vaporization of the incoming refrigerant, the gaseous refrigerant is passed through a gradient velocity oil separation chamber before entering the compressor. After condensation, the liquified refrigerant is introduced into a storage chamber. To provide additional purification of the refrigerant, the refrigerant in the storage cylinder is recirculated as part of a refrigeration cycle to lower the temperature of the reclaimed refrigerant and maximize the removal of impurities.

U.S. Pat. No. 4,998,416 of Van Steenburgh, Jr. describes a number of improvements to the basic design of the system described in the 4,967,570 patent, and points out some of the frailties of a reclaim design that uses an in-line compressor. For example, probably the biggest problem is in the significant load variations that are demanded of a compressor in a reclaim system. The mass flow of refrigerant through the compressor varies by orders of magnitude when liquid refrigerant is being reclaimed compared to when gaseous refrigerant is entering the system. The 4,998,416 Patent describes the use of means for cooling the compressor motor windings when the load requirements on the reclaim are reduced. This mechanism eliminates compressor failures caused by overheating and load variations.

Because the reclaim described in the 4,967,570 and 4,998,416 Patents contains an expansion/recycling refrigeration cycle, it is also necessary to include a plurality of expansion valves to allow for the use of the same reclaim with a number of refrigerants.

The 4,998,416 Patent describes one of the most efficient and trouble-free refrigerant reclaims available to date. However, even the apparatus disclosed therein is not capable of reclaiming all refrigerants. In particular, R-11 refrigerant can not be utilized with conventional, relatively small refrigerant compressors. Due to the physical characteristics of this widely used refrigerant, it is virtually impossible to maintain adequate oil lubrication within such compressors, and compressor destruction is the inevitable result.

As mentioned above, there are two general types of refrigerant reclaim systems. In the second type, the driving force for drawing the refrigerant from the refrigeration system is the reduction in pressure at a point downstream within the refrigerant reclaim. The low pressure regime is created by reduced temperature induced by a separate refrigeration cycle. In most of these systems, the refrigerant within the separate refrigeration cycle is the same refrigerant that is being reclaimed. See, e.g., U.S. Pat. No. 4,766,733 of Scuderi; U.S. Pat. No. 4,809,515 of Houwink, U.S. Pat. No. 4,903,499 of Merritt; and U.S. Pat. No. 4,939,903 of Goddard. These are really hybrid systems since both the reduced temperature and the compressor are used to withdraw the refrigerant into the reclaim.

An apparatus analogous to the second type of reclaim is described in U.S. Pat. No. 4,539,817 of Staggs et al. In Staggs, a completely separate refrigeration system is used to drive the withdrawal of refrigerant. Staggs, however, is simply a recovery and charging device. Staggs does illustrate how it would be possible to withdraw refrigerant from a refrigeration system without having to pass the refrigerant being reclaimed through a compressor.

The recovery and charging system disclosed in the Staggs patent has several major deficiencies. As in the type of reclaims that utilize compressors, the effects of widely varying loads is not addressed in Staggs. Even though a separate refrigeration cycle drives the withdrawal of refrigerant in Staggs, there are still dramatic load differentials on the compressor of the independent refrigeration system.

When the load requirements on a refrigeration cycle vary dramatically, the loss of load results in the loss of a mechanism for restoring heat to the refrigerant in the evaporator section of the refrigeration cycle. To compensate for this loss, liquid refrigerant may not be vaporized by the expansion valve, and some liquid refrigerant enters the compressor. This condition leads quickly to compressor destruction by "liquid slugging."

In Staggs, the heat exchange coil of the independent refrigeration cycle is contained within the refrigerant storage cylinder. By choosing the direction of flow of the independent refrigeration cycle, the heat exchange coil can act to either reduce the temperature of the interior of the chamber (thus drawing refrigerant to it) or raise the temperature of the interior of the chamber (thus aiding in the discharge of refrigerant). Although the theory of operation for such an apparatus is straightforward, by restricting the location of the heat exchange coil to the interior of the chamber it is generally impossible to maximize the temperature reduction—and pressure reduction—to allow the refrigerant withdrawal to proceed within commercially reasonable time frames. The same is also true for raising the temperature to discharge refrigerant from the storage cylinder.

It was the goal of the present invention to develop a refrigerant reclaim system that is capable of efficiently reclaiming all refrigerants in a single apparatus. By removing the in-line compressor as utilized in the 4,967,570 and 4,998,416 patents, it was possible to accommodate all refrigerants. However, the system also had to include means for purifying the reclaimed refrigerant, means for making the reclaim operate as efficiently as those using in-line compressors, and means for preventing compressor destruction due to liquid slugging.

SUMMARY OF THE INVENTION

The present invention provides methods and means for drawing refrigerant from a container or a refrigeration system. The system includes an independent refrigeration cycle comprised of a compressor, a condenser, a receiver, an evaporator, and bypass means for load control. The independent refrigeration cycle interacts with the reclaim portion of the reclaim system as a part of two heat exchange elements. Hot and gaseous refrigerant exiting the compressor flows through the hot side of a first heat exchange element. Expanding cooled refrigerant in the evaporator acts as the cold side of a second heat exchange element.

The cold side of the first heat exchange element contains incoming refrigerant to be reclaimed. The first heat exchange element therefore assures that all refrigerant entering the reclaim is vaporized. Refrigerant being reclaimed exiting the first heat exchange unit is then passed into an oil separation unit where substantially all entrained oil and water is removed from the refrigerant. The vaporous refrigerant exiting the oil separator is then passed through the hot side of the second heat exchange element. At this point the refrigerant is liquified and introduced into the refrigerant storage chamber of the reclaim device.

In one embodiment of the present invention, the refrigerant in the storage cylinder is recirculated back through the oil separator unit by removing refrigerant from the storage cylinder and introducing it into the cold side of the first heat exchanger. In an alternate embodiment, refrigerant in the storage cylinder is further purified by cycling through a drier unit and then returned to the storage cylinder.

In selected embodiments of the invention, all or a portion of the heated refrigerant exiting the compressor of the independent refrigeration cycle may be passed--in a closed, coiled loop--through the interior of the storage cylinder in order to raise the temperature of the interior of the storage cylinder to facilitate the discharge of reclaimed refrigerant.

In an additional embodiment of the invention an independent heat source is used to raise the temperature of the refrigerant in the storage cylinder to facilitate the discharge of refrigerant from the reclaim. In a final additional embodiment, a liquid pump is used to discharge refrigerant from the storage cylinder.

In a preferred embodiment of the present invention, the independent refrigeration system includes a modified receiver element with dual bypass valves. A first bypass valve is a condenser bypass. A second bypass valve is an evaporator bypass whereby the expansion valve can be bypassed when the load requirements on the independent refrigeration system are reduced. The combined action of the two bypass valves acts to prevent liquid slugging in the compressor when the load on the refrigeration cycle drops, by allowing heated gaseous refrigerant to bypass the condenser and the evaporator via the receiver.

In a preferred embodiment, the bypass valves are contained within the refrigerant receiver to assure a constant temperature on the valves. The bypass valves may either be of the gas pressure diaphragm type or may be directly temperature controlled valves. Each type of bypass valve is described in more detail, respectively, in U.S. Pat. Nos. 4,718,245 and 4,815,298 of Van Steenburgh, Jr.

DETAILED DESCRIPTION OF THE PREFERRED EMBODIMENTS

Figure 1:
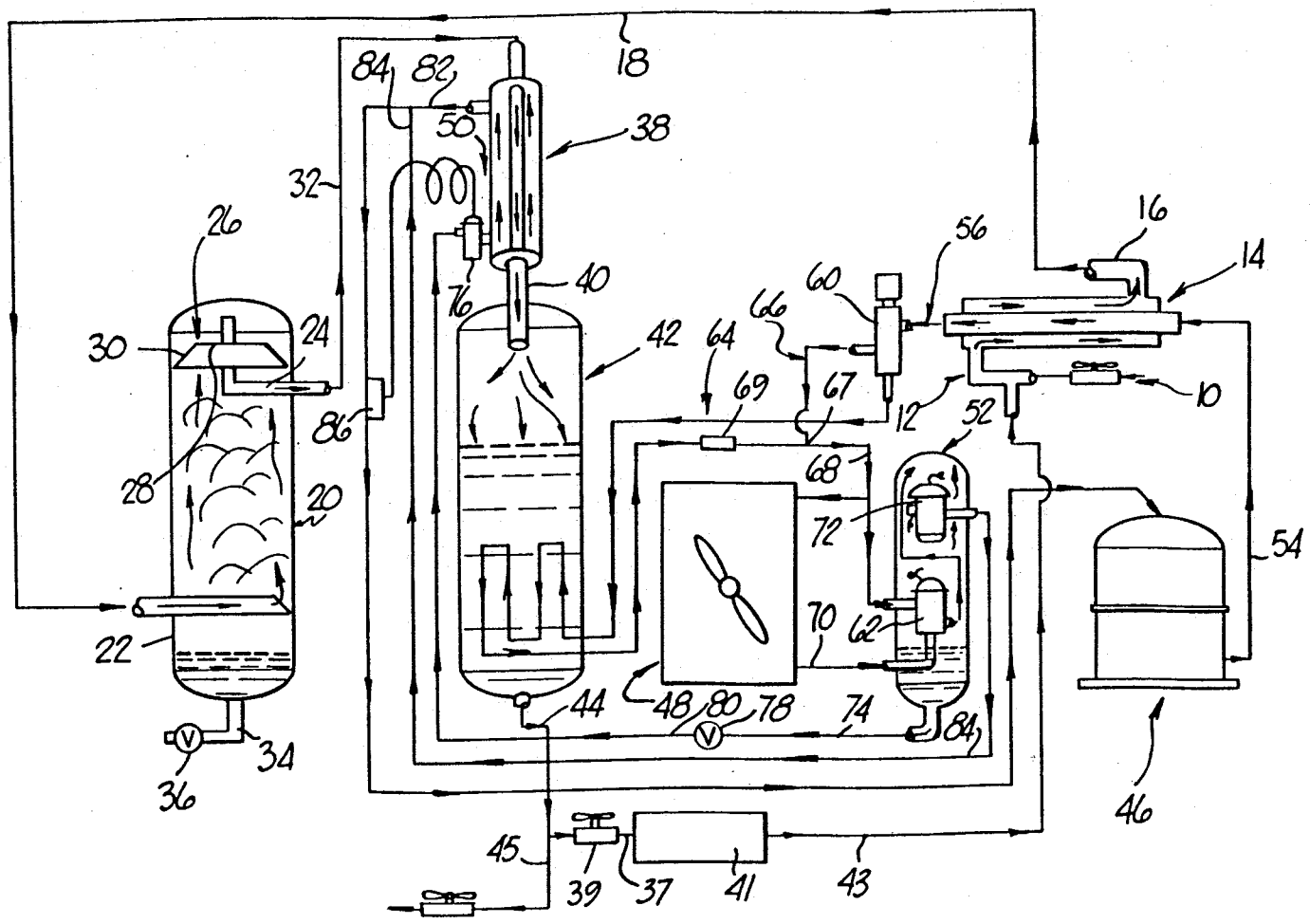
FIG. 1 is a schematic illustration of an embodiment of the invention wherein heat exchange coils are located within said storage cylinder for raising the temperature of the liquid refrigerant for assisting the discharge of refrigerant.

The present invention describes both an apparatus and method for reclaiming refrigerant. The term "reclaim" as used herein means the ability to withdraw, remove substantially all impurities, and to store or prepare for storage refrigerant that is contained in a refrigeration system. The reclaimed refrigerant need not necessarily be returned to the exact state of commercially available, previously-unused refrigerant, but it must be substantially free of contaminants. For example, the reclaim of the present invention is capable of reducing water impurities to less than 20 ppm by weight, and remove essentially all detectable levels of acidity (max. ppm by weight of 1.0 or less). A refrigerant reclaim is, therefore, an apparatus capable of reclaiming refrigerant.

A unique feature of the present invention is the ability to reclaim any refrigerant, independent of the refrigerants physical and chemical properties. Refrigerants that can be reclaimed according to this invention include those commercially available chloroflourocarbon refrigerants referred to as R-12, R-500, R-11, R-22 and R-502. Refrigerants that can be reclaimed according to this invention also includes other chemical compounds or mixtures of compounds that are currently or will be used in the future as replacements or substitutes for the chloroflourocarbon refrigerants.

The refrigerant reclaim apparatus of the present invention includes two refrigeration containing pathways. The secondary pathway, or "slave coil," contains the refrigerant that is being reclaimed. The secondary pathway is comprised of the cold side of a first heat exchange element, an oil separation chamber, the hot side of a second heat exchange element, and a refrigerant storage cylinder. In one embodiment of the invention, the primary system also includes means for transporting the refrigerant from the storage cylinder back to the cold side of the first heat exchange element, where the refrigerant will again be allowed to pass through the oil separation chamber. In another embodiment, the primary pathway will include means for transporting the refrigerant within the storage cylinder through a drier element and back to the storage cylinder.

In an alternate embodiment of the present invention the secondary system includes means for raising the temperature of the interior of the storage cylinder to aid in the removal of refrigerant stored therein for recycling of the refrigerant or for discharge of the refrigerant from the reclaim. In an alternate embodiment, the secondary system includes a liquid pump, capable of pumping against a pressure gradient, to facilitate the discharge of refrigerant from the storage cylinder.

The primary refrigerant containing pathway in the refrigerant reclaim of the present invention is an independent closed refrigeration system. The refrigeration system of the primary pathway is comprised of a compressor, a condenser, an evaporator and a receiver. U.S. Pat. Nos. 4,718,245 and 4,815,298 of Van Steenburqh, Jr. Which are commonly owned with the present invention, describe preferred embodiments of refrigeration systems to be used as the secondary refrigeration system of the present invention. Both U.S. patents are hereby specifically incorporated by reference.

The primary refrigeration system is, in a preferred embodiment, characterized by the existence of evaporator bypass and condenser bypass valves. The evaporator bypass and condenser bypass valves act cooperatively to prevent liquid slugging in the compressor during periods of reduced load. In those situations where the temperature of the refrigerant exiting the evaporator is so low that little, if any, refrigerant is vaporized by the thermal expansion valve, the evaporator bypass and condenser bypass valves open. With both valves open, heated gaseous refrigerant exiting the compressor passes directly—via the receiver—to some point down stream from the expansion valve. This acts to supply an artificial load on the system to compensate for the lack of load that created the potentially destructive situation. In one embodiment of the invention the bypass valves are held within the interior of the receiver.

The hot side of the first heat exchange element and the cold side of the second heat exchange element are also part of the primary refrigeration pathway. The refrigerant reclaim of the present invention functions due to the two points of interaction between the primary and secondary refrigeration pathways. The cold side of the second heat exchange element creates a low pressure zone in the hot side of the second heat exchange element which drives the removal of refrigerant from the container it is contained in. In the cold side of the first heat exchange unit all incoming refrigerant is vaporized before the refrigerant is passed into the oil separation chamber of the secondary refrigeration pathway. In a preferred embodiment, the oil separation chamber is of the gradient velocity type, as described in U.S. Pat. Nos. 4,967,570 and 4,998,416 of Van Steenburgh, Jr., which are incorporated herein by reference. Refrigerant exiting the oil separation chamber is drawn to the low pressure zone in the second heat exchange element, where the refrigerant is liquified and introduced into the storage cylinder. The apparatus and its operation are more fully discussed below in relation to the Figures to this application.

FIG. 1 depicts an embodiment of the refrigerant reclaim apparatus of the present invention. Because the refrigerant reclaim is comprised of two separate refrigerant containing pathways, the apparatus will be described in relation to the two pathways. It is, however, the interaction of the two systems that creates an operating refrigerant reclaim apparatus.

The secondary refrigeration pathway of the present invention contains the refrigerant being reclaimed. Refrigerant enters the reclaim at refrigerant inlet 10. Inlet 10 may include solenoid valve means or physical valve means for opening the inlet to allow the introduction of refrigerant. In a preferred embodiment, the inlet is further provided with means for only allowing access of refrigerant into but not out of the reclaim.

The inlet 10 is in fluid communication with conduit 12, which is, in turn, in fluid communication with the cold side of first heat exchange element 14. Throughout the specification of this application, heat exchange units are referred to as having hot and cold sides. Streams of relatively hot refrigerant and relatively cold refrigerant are maintained separate (not intermixed) but held in thermally conductive relationship to each other. In theory, in a totally efficient heat exchange unit, fluids exiting both sides of a heat exchanger will be the same temperature. The portion or side of the heat exchange element that contains the stream of refrigerant that is relatively hotter at the point that the stream enters the heat exchange element is referred to herein as the hot side of the heat exchange element, and the other side or portion of the heat exchange unit is referred to as the cold side of the heat exchange element.

In a preferred embodiment of the present invention, conduit 12 is in fluid communication with a conduit with spiral fins, or ridge and groove arrangement, facilitating its being mounted within a conduit to form a so-called tube-within-a-tube heat exchanger. Preferably the tube-within-a-tube construction is in the form of a coil so as to provide greater length in a smaller space than would be possible with a straight tube-within-a-tube. The coiled tube-within-a-tube is a standard item well known in the heat exchange art, and it is almost universally utilized so that the inner tube is the hot side of the heat exchanger.

Conduit 16 constitutes the outlet from the cold side of the first heat exchange element 14, and is in fluid communication with the oil separation chamber 20 through conduit 18. In the embodiment depicted herein, the oil separation chamber 20 is an elongated pressure cylinder with partially spherical ends mounted so that its longitudinal axis extends vertically. The fluid conduit 18 extends through the outer wall 22 of the oil separator chamber 20 in the bottom half of the tank.

Another fluid conduit 24 has its open end fixed near the inner surface of the rounded top of the tank. This fluid conduit 24 extends downwardly and supports a circular baffle 26 composed of a disc-like portion 28 and a downwardly extending partially cone-shaped skirt 30. Conduit 24 is arranged to extend along the axis of the tank and is connected to conduit 32 exiting the oil separation chamber 20. Oil from the bottom of oil separation chamber 20 can be discharged through fluid conduit 34, controlled by solenoid valve 36.

Fluid conduit 32 is in fluid communication with the hot side of second heat exchange element 38. Conduit 40 exits the hot side of the second heat exchange element 38. In a preferred embodiment, the second heat exchange element 38, is also a tube-within-a-tube heat exchanger as described above.

Conduit 40 enters into and is in fluid communication with the interior of refrigerant storage cylinder 42. The refrigerant storage cylinder 42 is illustrated in FIG. 1 as an elongated, cylindrical pressure tank arranged with its longitudinal axis extending vertically and having upper and lower ends of partially spherical shape. In the preferred embodiment, the second heat exchange element 38 is located physically above the refrigerant storage cylinder.

Conduit 44 exits out of and is in fluid communication with the interior of the refrigerant storage cylinder 42. As described above for the inlet, the outlet 45 may include solenoid valve means or physical valve means for opening the outlet to allow refrigerant to exit the reclaim. Also in fluid communication with outlet conduit 45 is fluid conduit 37. Access into fluid conduit 37 is controlled by recycle valve 39. When valve 39 is open, conduit 37 is in fluid communication with drier unit 41. Such drier unit may be any one of a number of widely-used, commercially available refrigerant drier units. The exit of drier unit 41 is in fluid communication with the cold side of first heat exchange element 14 via conduit 43.

In addition to the secondary refrigeration pathway as described above, FIG. 1 also depicts a primary refrigeration pathway. The primary refrigeration pathway is a closed system, and it may utilize any refrigerant desired. In a preferred embodiment, the primary refrigeration pathway utilizes R-502. The refrigerant in the primary refrigeration pathway does not physically contact or commingle with the refrigerant being reclaimed in the secondary refrigeration pathway.

The primary refrigeration pathway is comprised, in part, of a compressor 46, a condenser 48, an evaporator 50, and a receiver 52. Conduit 54 exits and is in fluid communication with the outlet of refrigerant compressor 46. Conduit 54 is, in turn, in fluid communication with the inlet of the hot side of first heat exchange element 14. Conduit 56 is in fluid communication with the outlet of the hot side of first heat exchange element 14. Conduit 56 is also in fluid communication with 3-way valve 60.

3-way valve 60 is designed to allow conduit 56 to be in fluid communication with either, but not both, fluid conduits 64 or 66. Valve 60 may be solenoid operated or controlled by physical manipulation. Conduit 64 extends into the top bottom portion of refrigerant storage cylinder 42, forms a coil within the cylinder and exits the cylinder. The contents of conduit 64 are not in fluid communication, but are in thermal conductive relationship with, the contents of the storage cylinder. Conduit 64, after it exits the storage cylinder, and conduit 66 merge at a t-joint 67 which is in fluid communication with conduit 68. Conduit 64, after exiting the storage cylinder and before t-joint 67, contains a check valve 69 which will prevent flow of refrigerant towards the storage cylinder.

Conduit 68 is in fluid communication with the entrance to air condenser 48, and condenser bypass valve 62, which is located within the interior of receiver 52. Condenser 48 may be equipped with a fan to increase cooling of the contents of the condenser 48. The exit of condenser 48 is in fluid communication with conduit 70. Conduit 70 enters into the interior of receiver 52 and is in fluid communication with condenser bypass valve 62. Also located within receiver 52, is evaporator bypass valve 72.

Conduit 74 is in fluid communication with the interior of the receiver and is connected to the receiver 52 near its bottom. Conduit 74 is in fluid communication with thermal expansion valve 76. At some point in conduit 74, outside of the receiver, is located a first flow restriction valve 78. The flow restriction valve 78 is preferably a solenoid controlled valve. Conduit 80 is in fluid communication with the exit of the thermal expansion valve 76 and the cold side of second heat exchange element 38. Together, the thermal expansion valve 76 and the cold side of the second heat exchange element 38 are referenced to herein as the evaporator 50 of the primary refrigeration pathway.

Conduit 82 is in fluid communication with the exit of the cold side of the second heat exchange element 38 and the inlet to refrigerant compressor 46. Conduit 84, which is associated with evaporator bypass valve 72, exits through the receiver 52 wall and is in fluid communication with conduit 82. In alternate embodiments of the present invention, conduit 84 may instead be in fluid communication with conduit 80 between the thermal expansion valve 76 and the second heat exchange element 38.

The thermal expansion valve 76 is controlled generally according to the temperature of the refrigerant in the outlet conduit 82 from the evaporator, by means of a thermostat 86 secured to the outlet conduit 82 and controlling a valve operator on the thermal expansion valve 76.

Under certain pressure/temperature conditions, condenser bypass valve 62 directs the flow of refrigerant from conduit 68 directly to the receiver 52, bypassing condenser 48. In addition, evaporator bypass valve 72 allows gaseous refrigerant at a high temperature and pressure to flow directly to conduit 82 (or in the alternative embodiment—not shown—to conduit 80), bypassing at least the thermal expansion valve 76 when the temperature and pressure in the evaporator are below a predetermined level. This low-pressure (low temperature) evaporator condition would prevail, for example, when the amount of refrigerant in the primary refrigerant pathway is low.

In one embodiment of the invention, the bypass valves 62, 72 are pressurized diaphragm biased disk valves, and each includes a pressure dome and diaphragm operator. The pressure dome defines a chamber closed by a flexible diaphragm. An adjusted gas pressure is established and maintained in the dome chamber, in opposition to a coil spring or other mechanical biasing device, to provide a constant, predetermined differential biasing force on the valve at a given temperature. In order to maintain the gas at a relatively constant pressure, it is helpful to maintain the gas at a relatively constant temperature. Accordingly, in a preferred embodiment, the valves 62, 72, are desirably placed and hermetically sealed in the receiver 52 as shown in FIG. 1.

Condenser bypass valve 62 is a three-way valve for supplying refrigerant to the receiver 52, either from the condenser 48 or from the compressor 46 (through the hot side of the first heat exchange element 14) bypassing the condenser 48. When the pressure in the receiver 52 is low, the valve shifts to provide for the flow of gaseous refrigerant at a relatively high temperature and pressure directly into the receiver 52. The receiver pressure can drop, for example, when the surrounding temperature falls to a sufficiently low level or the amount of liquid in the receiver drops to an undesirable low level, thereby causing the receiver pressure to drop sufficiently below the required operating pressure for the refrigerant thermal expansion valve 76. Discharge of hot pressurized gas directly into the receiver 52 serves to pressurize the receiver 52 back to normal operating pressure and temperature. When the pressure in the receiver is increased, the condenser bypass valve no longer acts to bypass the condenser, and refrigerant exiting the hot side of first heat exchange element 14 goes to 3-Way valve 60.

The 3-way valve 60 can be set to either direct the gaseous refrigerant directly to the condenser 48 via conduit 66, or indirectly via conduit 64. Refrigerant will be directed through conduit 64 when it is desireable to raise the temperature of the contents of the refrigerant storage cylinder 42.

The evaporator bypass valve 72 is utilized to supply hot gas directly from the compressor 46 (via the receiver 52) to a point beyond the thermal expansion valve 76 during low load conditions, in order to allow efficient operation of the evaporator 50. The use of such bypass valves is well known in the art. In the preferred embodiment, the evaporator bypass valve 72 operates in the same manner as the condenser bypass valve 62 described above, and is also contained within the receiver 52. The evaporator bypass valve 72, when open, allows hot, compressed refrigerant gas from the receiver 52 to a point downstream from the thermal expansion valve 76.

The bypass valves that are preferred for use in this invention are described in more detail in U.S. Pat. Nos. 4,815,298 and 4,718,245, which are specifically incorporated herein by reference. A receiver containing the two bypass valves can be purchased as the HEAD START receiver from Van Steenburgh Engineering Laboratories, Inc., Denver, Colo. However, the bypass valves as described herein need not be located in the receiver to effectively prevent compressor liquid slugging during low load operation.

The reclamation of refrigerant according to the present invention and utilizing the apparatus shown in FIG. 1 is quite straightforward. Because of the automatic nature of the bypass valves 62, 72 in the secondary refrigeration pathway, little is required to operate the system. The first operational step is to turn on the compressor and allow the primary refrigeration pathway to operate long enough to generate a low pressure zone in the hot side of second heat exchange element 38. The 3-way valve 60, should be positioned to allow refrigerant to proceed only through conduit 66 to the condenser 48. The inlet 10 to the secondary refrigeration pathway is then connected to the source of refrigerant to be reclaimed, and the inlet valve opened. The incoming refrigerant will pass through inlet 10, into conduit 12 and through the cold side of first heat exchange element 14. Liquid refrigerant is vaporized within the heat exchange element, and the gaseous refrigerant proceeds through conduits 16 and 18 into oil separation chamber 20.

The refrigerant entering the oil separation chamber 20 is relatively hot and is an expanding gas rising rapidly within the tank of the oil separator 20. The upward flow of gas is abruptly interrupted by the baffle 26 causing oil and water mist to be separated and to drop to the bottom of the chamber. The gaseous refrigerant passes around the outer edge of skirt 30 which is spaced from the interior wall of the surrounding tank by an amount roughly equivalent to the open area at the upper end of conduit 24. The gaseous refrigerant passes around skirt 30 into the upper end of conduit 24.

The refrigerant passes from conduit 24, to conduit 32 and into and through the hot side of heat exchange element 38. In heat exchange element 38 the gaseous refrigerant is condensed and flows through conduit 40 into refrigerant storage cylinder 42. When the container containing the refrigerant being reclaimed has been completely evacuated, the inlet 10 is closed.

To discharge refrigerant from the refrigerant storage cylinder, 3-way valve 60 is repositioned to allow hot gaseous refrigerant to pass through conduit 64 and to raise the temperature within the refrigerant storage cylinder 42. The container into which the refrigerant is to be charged is connected to outlet 46 and, when desired, outlet 46 is opened to allow the reclaimed refrigerant to flow through conduit 44 and out outlet 46.

Figure 2:
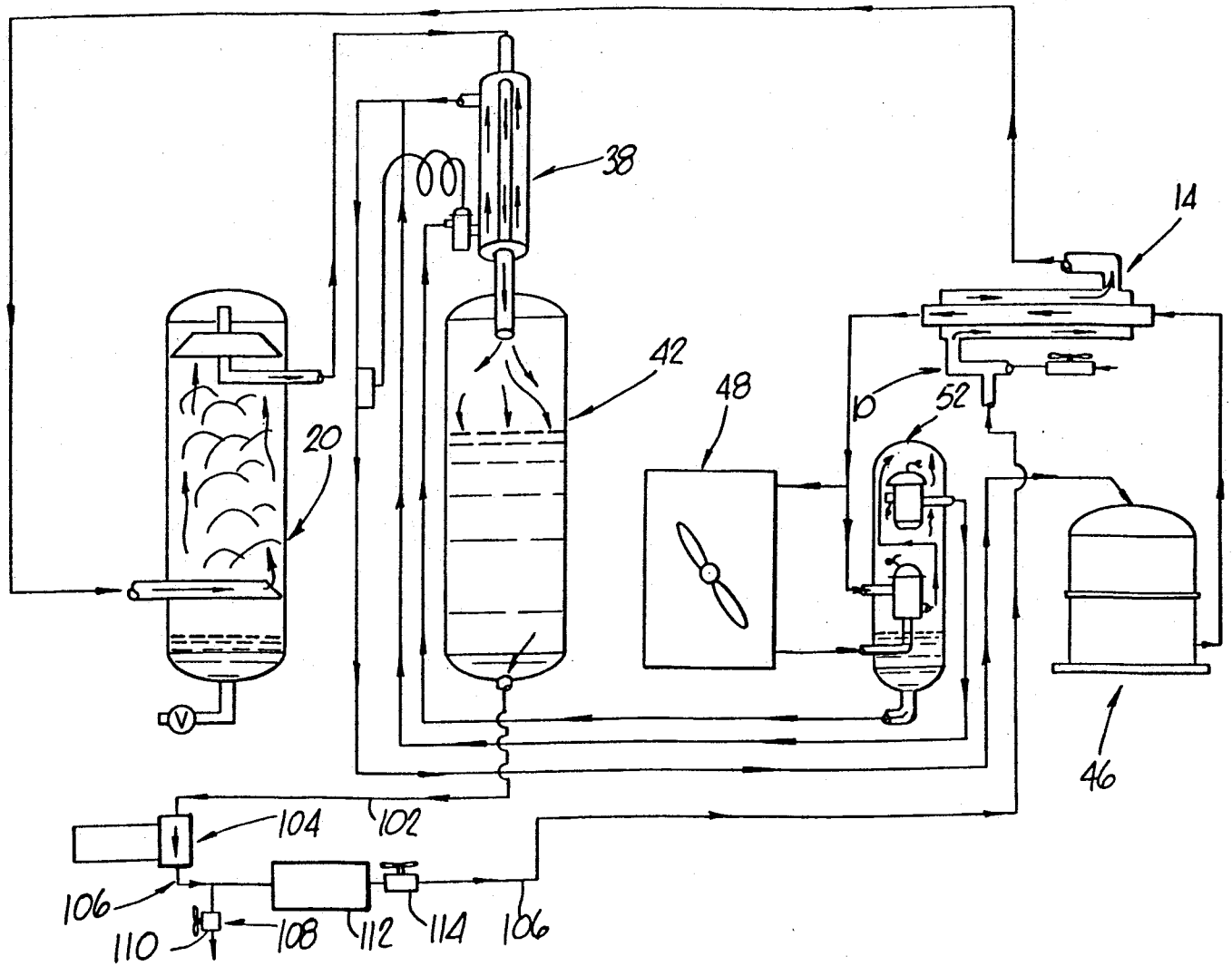
FIG. 2 is a schematic illustration of an embodiment of the invention wherein a liquid pump is included for recycling refrigerant in the storage cylinder and for assisting discharge of refrigerant.

FIG. 2 depicts an alternate embodiment of a portion of the refrigerant reclaim of the present invention. In this embodiment, the refrigerant storage cylinder 42 does not contain the heat exchange coils of conduit 64 to allow for raising the temperature of the interior of the storage cylinder. In this embodiment, conduit 102 exits and is in fluid communication with, the interior of the refrigerant storage cylinder 42. Conduit 102 is also in communication with the inlet of a liquid pump 104. The outlet of liquid pump 104 is in communication with fluid conduit 106, which is in communication with both refrigerant outlet conduit 108, and refrigerant inlet 10.

Refrigerant outlet conduit 108 contains an outlet valve 110, which is preferably operated by a solenoid control. Conduit 106 also contains a drier filter 112 and a flow control valve 114 for allowing access to the inlet 10. The flow control valve 114 is preferably operated by a solenoid control. In a preferred embodiment, the liquid pump 104 is capable of pumping liquid refrigerant against a pressure gradient. Preferably, the liquid pump 104 is a Tuthill Magnet Drive Gear Pump manufactured by Tuthill Pump Co. of California, Concord, Calif.

In this embodiment of the invention, if it is desired to discharge refrigerant from the storage cylinder 42, the liquid pump 104 is turned on and outlet valve 110 is opened and flow control valve 114 is shut. If it is desired to recirculate refrigerate for enhanced removal of impurities, the secondary refrigeration pathway must be operating, and the liquid pump 104 turned on, outlet valve 110 shut and flow control valve 114 opened. In an alternate embodiment of FIG. 2, not shown, conduit 106 may be in communication with the interior of the storage cylinder 42 rather than inlet 10. In this mode, the refrigerant will be passed through a filter drier, but not the oil separator chamber, before being returned to the storage cylinder.

Figure 3:
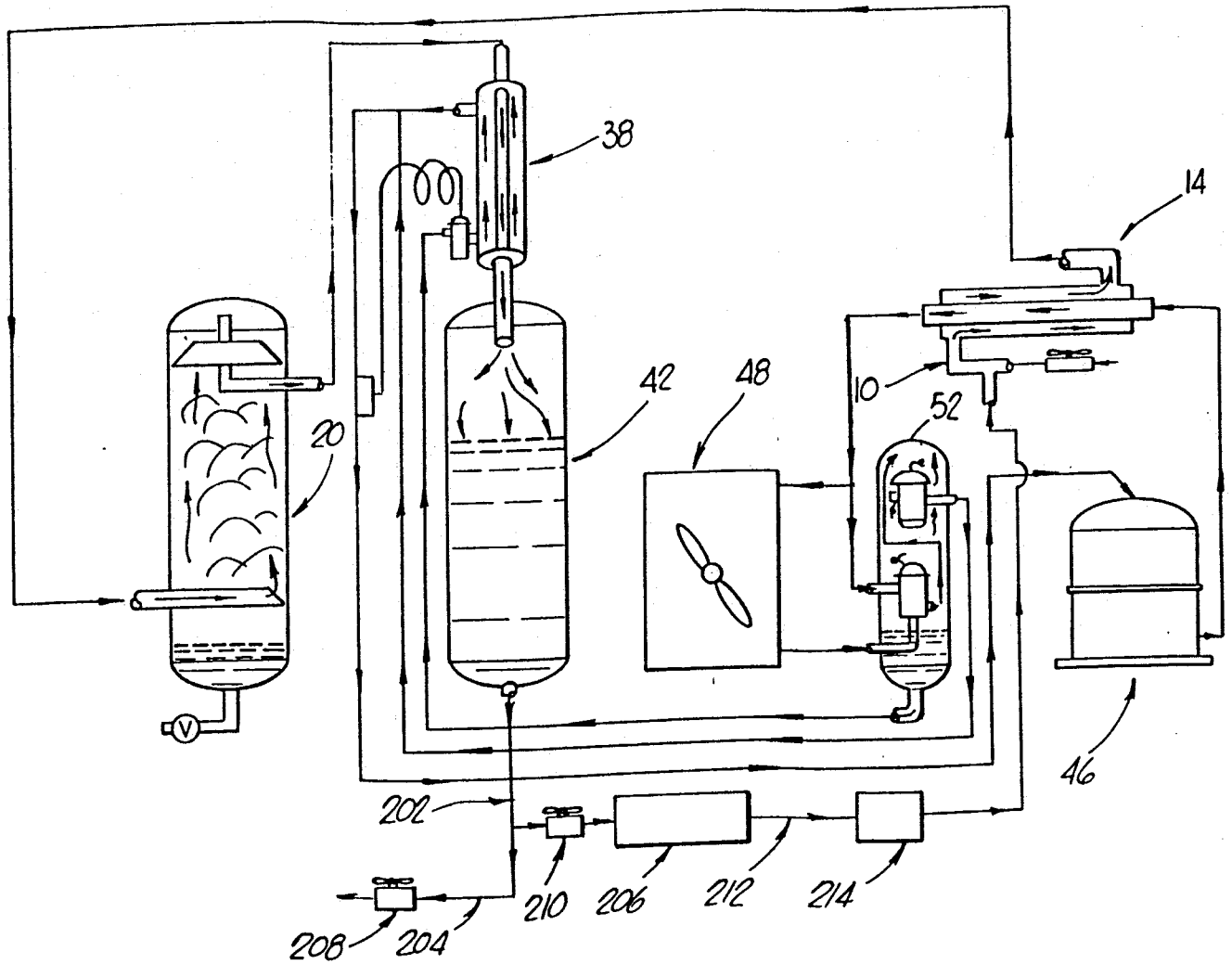
FIG. 3 is a schematic illustration of an embodiment of the invention wherein an external heat source is utilized to raise the temperature of the liquid refrigerant for assisting the recycling or discharge of refrigerant.

FIG. 3 depicts a further embodiment of the apparatus of the present invention. In this embodiment, again the refrigerant storage cylinder 42 does not contain the heat exchange coils of conduit 64. However, additional means are included for raising the temperature of the contents of the refrigerant storage cylinder for assisting in the discharge and recycling of refrigerant reclaimed and held in the refrigerant storage cylinder 42.

Conduit 202 exits, and is in fluid communication with, the interior of the refrigerant storage cylinder 42. Conduit 202 is in communication with both refrigerant outlet conduit 204, and liquid heating element 206. Outlet conduit 204 contains an outlet valve 208, which is preferably operated by a solenoid control. Conduit 202, just prior to liquid heating element 206, also contains a flow control valve 210 for allowing access into the liquid heating element 206. Again, preferably flow control valve 210 is operated by a solenoid control.

The outlet of the liquid heating element 206 is in communication with conduit 212, which enters into and is in fluid communication with inlet 10. Conduit 212 also contains a drier filter 214 apparatus. By closing outlet valve 208, opening flow control valve 210, and turning on liquid heating element 206, refrigerant will flow through 202 into the liquid heating element 206, into conduit 212 and through drier filter 214 and into inlet 10. By opening outlet valve 208 and closing flow control valve 210, refrigerant can be discharged from the reclaim as described above in conjunction with FIG. 1. In an alternate embodiment, conduit 212 can be made to return the recycled refrigerant directly back to the storage cylinder.

As would be obvious to one of ordinary skill in the art, various aspects of the operation of the refrigerant reclaim of the present invention may be operated and controlled at a central control panel or by microprocessor control. The design and implementation of such control elements are within the skill and ability of those ordinarily skilled in the art without undue experimentation.

The above description of the present invention is intended to provide an illustration of the concepts of the present invention, but should not be read to unduly limit the scope of the claims as presented below.

I claim:

1. A refrigerant reclaim comprised of:

a first heat exchanger wherein a refrigerant entering said reclaim is vaporized to a gaseous refrigerant;

an oil separation chamber in fluid communication with said first heat exchanger for removing oil from said gaseous refrigerant;

a second heat exchanger in fluid communication with said oil separator wherein said gaseous refrigerant is condensed to a liquid; and a refrigerant storage cylinder in fluid communication with said second heat exchanger.

2. The refrigerant reclaim of claim 1 wherein said refrigerant entering said reclaim is drawn into the reclaim due to a low pressure zone in said second heat exchanger.

3. The refrigerant reclaim of claim 1 wherein said oil separation chamber is a gradient velocity oil separator.

4. The refrigerant reclaim of claim 1 further comprising:

recycling means comprised of means for removing refrigerant from said storage cylinder, passing said refrigerant through a device for removing impurities from said refrigerant, and returning said refrigerant to said storage cylinder.

5. A method for reclaiming refrigerant comprised of:

vaporizing refrigerant to be reclaimed in the cold side of a first heat exchange element;

removing impurities from said gaseous refrigerant in a oil separation chamber;

condensing said refrigerant from said oil separation chamber in the hot side of a second heat exchange element; and collecting said condensed refrigerant in a storage cylinder.

6. The method of claim 5 further comprising: recycling condensed refrigerant in said storage cylinder by removing said refrigerant, passing it through means for removing impurities, and returning said refrigerant to said storage cylinder.

* * * * *